US008465405B2

(12) United States Patent
Horstkötter et al.

(10) Patent No.: US 8,465,405 B2
(45) Date of Patent: Jun. 18, 2013

(54) SOLID-BOWL SCREW CENTRIFUGE WITH OUTLET OPENINGS FOR PARTIAL AND RESIDUAL EMPTYING OF THE DRUM

(75) Inventors: Ludger Horstkötter, Ennigerloh (DE); Hans-Joachim Beyer, Ennigerloh (DE); Ulrich Horbach, Hamm (DE); Johannes Droste, Rosendahl (DE)

(73) Assignee: GEA Mechanical Equipment GmbH, Oelde (DE)

( * ) Notice: Subject to any disclaimer, the term of this patent is extended or adjusted under 35 U.S.C. 154(b) by 854 days.

(21) Appl. No.: 12/294,809

(22) PCT Filed: Mar. 21, 2007

(86) PCT No.: PCT/EP2007/052697

§ 371 (c)(1),
(2), (4) Date: Sep. 16, 2009

(87) PCT Pub. No.: WO2007/113113

PCT Pub. Date: Oct. 11, 2007

(65) Prior Publication Data

US 2010/0035742 A1 Feb. 11, 2010

(30) Foreign Application Priority Data

Mar. 30, 2006 (DE) ..... 10 2006 015 211
Jul. 1, 2006 (DE) ..... 10 2006 030 477

(51) Int. Cl.
*B04B 1/20* (2006.01)
*B04B 11/04* (2006.01)

(52) U.S. Cl.
USPC ..... 494/53; 494/56

(58) Field of Classification Search
USPC ..... 494/53–54, 56–57; 210/380.1, 380.3
See application file for complete search history.

(56) References Cited

U.S. PATENT DOCUMENTS

| | | | | |
|---|---|---|---|---|
| 5,169,377 | A * | 12/1992 | Schlip et al. | 494/56 |
| 5,217,428 | A * | 6/1993 | Schlip et al. | 494/56 |
| 5,593,377 | A * | 1/1997 | Figgener et al. | 494/56 |
| 5,618,409 | A * | 4/1997 | Kreill | 210/97 |
| 7,083,565 | B2 * | 8/2006 | Hermeler et al. | 494/53 |
| 7,326,169 | B2 * | 2/2008 | Bruning et al. | 494/56 |
| 7,510,519 | B2 * | 3/2009 | Reichenbach et al. | 494/57 |
| 2004/0058796 | A1 * | 3/2004 | Feldkamp et al. | 494/56 |
| 2005/0164861 | A1 * | 7/2005 | Bruning et al. | 494/56 |
| 2006/0142137 | A1 | 6/2006 | Hermeler et al. | |

FOREIGN PATENT DOCUMENTS

| | | | |
|---|---|---|---|
| DE | 36 20 912 | A1 | 12/1987 |
| DE | 37 28 901 | C1 | 11/1988 |
| DE | 38 21 486 | A1 | 12/1989 |
| DE | 38 29 158 | A1 | 3/1990 |
| DE | 39 11 320 | A1 | 10/1990 |
| DE | 41 30 759 | A1 | 3/1993 |
| DE | 100 65 060 | A1 | 7/2002 |
| DE | 102 09 925 | A1 | 9/2003 |
| GB | 998669 | | 7/1965 |
| JP | 2003-135996 | * | 5/2003 |
| WO | 03/074185 | A1 * | 9/2003 |

* cited by examiner

*Primary Examiner* — Charles E Cooley
(74) *Attorney, Agent, or Firm* — Barnes & Thornburg LLP

(57) ABSTRACT

A solid-bowl centrifuge that includes a drum rotatable about a horizontal axis of rotation and a screw arranged in the drum. Also included are a continuous solids discharge located at a first end of the drum and a continuous liquid discharge located at a second, opposite end of the drum. Further included is at least one discontinuously acting outlet opening including a closure device.

17 Claims, 5 Drawing Sheets

SOLID-BOWL SCREW CENTRIFUGE WITH OUTLET OPENINGS FOR PARTIAL AND RESIDUAL EMPTYING OF THE DRUM

CROSS-REFERENCE TO RELATED APPLICATIONS

This application is a National Phase Application based upon and claiming the benefit of priority of PCT/EP2007/052697, filed on Mar. 21, 2007 and of German Application No. 10 2006 015 211.5, filed on Mar. 30, 2006 and of German Application No. 10 2006 030 477.2, filed on Jul. 1, 2006, the contents of these Applications being hereby incorporated herein by reference.

BACKGROUND AND SUMMARY

The present disclosure relates to a solid-bowl screw centrifuge including a drum rotatable about, for example, a horizontal axis of rotation. A rotatable screw is arranged in the drum. The centrifuge includes a continuous solid discharge at one end of the drum and a continuous liquids discharge at an opposite end of the drum. Further included is at least one discontinuously acting outlet opening having a closure device.

A wide range of designs of solid-bowl screw centrifuges are known. As the drum slows down, the ring of liquid in the drum collapses below a threshold rotational speed, so that the residual liquid collects in the bottom of the drum. To allow the residual liquid that then remains to be completely emptied, or to prevent emptying via the solids side or the liquid side, it is known for the residual liquid to be discharged through separate outlet openings. Valves or slides are fitted into the separate outlet openings and may, for example, be spring-loaded, according to the document DE 41 30 759 A1.

Further prior art includes DE 36 209 12, which proposes that the liquid discharge be realized purely by openings in the drum lateral surface, which are assigned conical adjustment elements that can each be actuated by means of separate piston-cylinder units or slides. DE 39 11 320 A1 discloses a further prior art design.

The designs which have been described above are relatively complex and are susceptible to operational disruption. The present disclosure relates to a centrifuge of a more simple design than described above.

The present disclosure relates to a solid-bowl centrifuge that includes a drum rotatable about a horizontal axis of rotation, a screw arranged in the drum, a continuous solids discharge located at a first end of the drum, and a continuous liquid discharge located at a second, opposite end of the drum. Further included is at least one discontinuously acting outlet opening including a closure device, the closure device including a ring configured to be axially displaced relative to the horizontal axis of rotation and rotatable with the drum during an operation of the centrifuge. Also included is an actuating device assigned to the closure device, by which actuating device the ring is displaced into a first position which opens the at least one outlet opening and into a second position which closes the at least one outlet opening.

According to the present disclosure, the at least one outlet opening is assigned a ring. The ring can be axially displaced relative to the drum axis and rotates with the drum in operation. The ring is assigned an actuating device, by which actuating device the ring can be displaced into a position which opens up the at least one outlet opening and into a position which closes the at least one opening completely. This design is of simple construction and is operationally reliable, since it does not use valves or individual slides, which are susceptible to faults.

Moreover, the centrifuge according to the present disclosure allows simultaneous opening and closing of all emptying or outlet openings using just one master actuating device. For CIP (Cleaning In Process) applications, there is no need for the drum to be stopped first, since the CIP program can be initiated immediately after emptying, with the drum still rotating or even without any reduction in speed at all.

When the drum is stopped, undesirable residual emptying, in particular toward the solids side, is avoided in a simple way. The liquid level collapses as a result of an increasing drop in speed. By contrast, in the prior art, under certain circumstances liquid was washed over through the drum outlets. Liquid oscillations as the drum stops are also avoided.

Further prior art includes DE 102 09 025 A1. FIG. 4 of DE 102 09 025 discloses a ring which is displaceable axially outside a drum opening but cannot close the opening. That is because its external circumference is so much greater than the external circumference of the drum in this region that a gap always remains between the drum and ring. By contrast, according to the present disclosure, the ring completely closes the outlet openings, since the internal diameter of the circumferentially continuous ring and the external diameter of the drum are correspondingly matched to one another.

The actuating device may be designed as a fluidic, or hydraulic, actuating device. An actuating device of this type is of compact construction, is particularly operationally reliable and also relatively easy to implement on the rotating drum.

According to an embodiment of the present disclosure, such embodiment being simple to implement and inexpensive, the outlet openings are formed as apertures, such as drilled holes or slots, in the lateral surface of the drum. The embodiment including the slots is adapted for effective discharging of even a solids phase, since the slots may have a relatively large cross section. The slots may extend in the circumferential direction.

According to another embodiment of the present disclosure, the outlet openings are arranged axially before the continuously acting liquid discharge, which is effected, for example, by a scraper disk or by further openings in the drum lid.

It is advantageous if the outlet openings are formed in the lateral surface of the drum in such a manner that they lie radially outside a separation and/or clarification disk set made up of disks, with the clarification disk set connected upstream of the continuous liquid discharge. Disk sets in decanters are known for example from DE 100 65 060 A1.

Particularly in this upstream region, the additional outlet openings are particularly useful, since they can be used not only to drain out a residual liquid level but also for partial emptying, for example, a partial volume of 10 liters (1) during production or processing at full speed.

Alternatively, according to the present disclosure, it is possible to arrange the outlet openings in the drum lid.

In such an alternative, in particular in operation with the drum still rotating at high speed, it is possible to discharge flowable solids or product which has accumulated on the inner circumference of the drum lateral surface in this axial region of the drum.

Self-emptying drum separators of a different generic type are known, for example, from DE 38 21 486 A1 or DE 38 29 158 A1, which have ring slides for closing solids discharge openings. By contrast, in a decanter or centrifuge, according to the present disclosure, additional discharge openings are provided, which do not replace but rather complement the continuous solids discharge openings at the conical end of the drum, in order to simplify residual emptying of the drum.

Other aspects of the present disclosure will become apparent from the following descriptions when considered in conjunction with the accompanying drawings.

DETAILED DESCRIPTION

Figure 5:
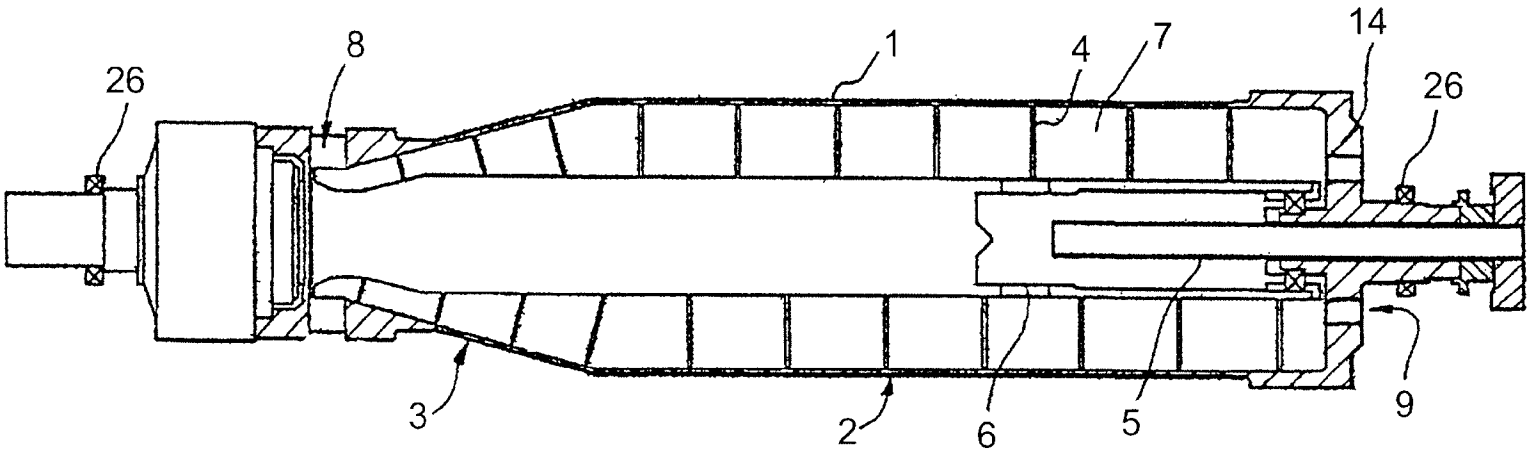
FIG. 5 PRIOR ART
FIG. 5 shows a known solid-bowl screw centrifuge.

FIG. 5 shows a solid-bowl screw centrifuge having a drum 1 which can rotate about a horizontal axis of rotation and which has a cylindrical portion 2 and a tapering portion 3. A rotatable screw 4 is arranged in the drum 1. The centrifuge has a configuration and mode of operation such that the drum 1 and the screw 4 have a rotational speed difference, generally a relatively minor one, in operation. The drum bearing is designated by reference numeral 26.

Figure 1:
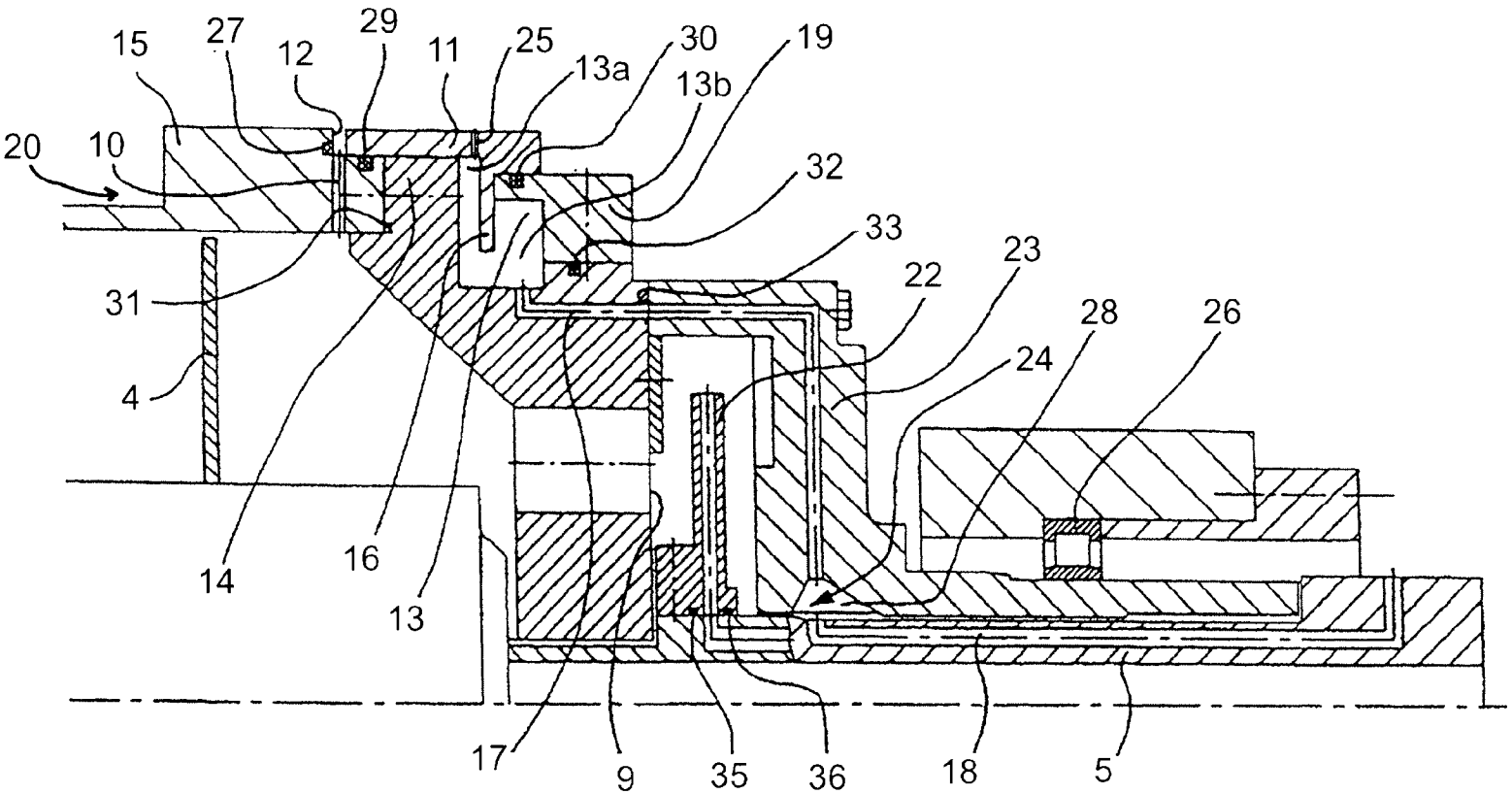
FIG. 1 shows a partial sectional view of a portion of a first embodiment of a solid-bowl screw centrifuge in a first operating position, in accordance with the present disclosure.

The solid-bowl screw centrifuge of FIG. 1 is used to separate a product that is passed through a feed pipe 5 and a manifold 6 into the centrifuging space 7 in the drum 1. The product is separated into at least a solids phase and one or more liquid phases. On account of the density difference, the solids phase accumulates at the outside of the drum 1, from where it is carried by the screw 4 toward a solids discharge 8 at a tapering end of the drum 1 and is then continuously removed from the drum 1 through the solids discharge 8.

By contrast, the at least one liquid phase is continuously discharged at the opposite end of the drum 1 by at least one liquid discharge.

In a drum 1 as shown in FIG. 5, the liquid discharge can be realized in various ways. FIGS. 1 to 4, according to the present disclosure, show designs which can be used in a decanter or centrifuge that can otherwise correspond to that shown in FIG. 5.

In general, a drum lid 14, which closes the drum 1 at the cylindrical end, has at least one weir-like passage opening 9, which opening 9 forms the liquid discharge. However, a discharge in some other form, for example by a scraper disk 22 (see FIG. 1) is also possible. If a plurality of liquid phases are to be discharged, they are removed through liquid outlets on different radii of the centrifuging space 7. The liquid discharge takes place continuously.

The centrifuge, as shown in FIG. 1, has in addition or modification to the known design shown in FIG. 5. For example, outlet openings 10 (see, for example, FIGS. 1 and 4), which are circumferentially distributed over the outer circumference of a drum lateral surface 20 (see FIGS. 1-4) and are assigned a closure device, which makes it possible to open and close the outlet openings 10 as the drum 1 is operating. At least two or four or more outlet openings 10 are distributed over the circumference.

The fact that the outlet openings 10 are formed and distributed directly in the drum lateral surface 15 has an advantage in that they can easily be formed as apertures in the drum lateral surface 20 component and there is no need to route outlet ducts through the drum lid 14.

In a structurally simple configuration, the closure device for the outlet openings 10, as shown in FIG. 1, is formed as a cylindrical ring 11. During operation, the cylindrical ring 11 rotates with the drum 1 and is guided axially displaceably on the drum 1 and/or the drum lid 14 and/or a component connected to the drum lid 14.

It is in this way possible to achieve a discharge of liquid from the drum 1 which is discontinuous or is realized only in suitable operating situations.

The outlet openings 10 are formed axially just before that end region of the drum lateral surface 20 which faces the drum lid 14. At its axial end before the drum lid 14 the drum lateral surface 20 includes a radially protruding collar 15, which is provided with a step 12. In accordance with FIGS. 1 to 3, the outlet openings 10 are a formed in this region.

The ring 11 is guided displaceably on the outer circumference of the drum lid 14.

Since the ring 11 in operation rotates with the drum 1, it is necessary to allow it to be easily axially displaced in operation. This is realized, for example, fluidically or hydraulically.

As shown in FIG. 1, the centrifuge includes an hydraulic chamber 13, into which chamber 13 an inner, disk-like, radial attachment 16 of the ring 11 extends. Chamber 13 is formed in the drum lid 14, so that an opening chamber 13*a* is formed on one side of the attachment 16 (shown to the left of attachment 16 in FIG. 1) and a closure chamber 13*b* is formed on the other side of the attachment 16. The radial extent of the opening chamber 13*a* is greater than that of the closure chamber 13*b*.

The attachment 16 extends radially from the outside inward into the hydraulic chamber 13. The opening chamber 13*a* and the closure chamber 13*b* are operatively connected on the radially inner side.

A hydraulic conduit 17 passes through the drum lid 14 and through adjoining rotating parts 23 and opens out into a ring chamber 24. Located in a region of ring chamber 24, there is a transition to a feed line 18 on the non-rotating feed pipe 5. Hydraulic conduit 17 opens out into the closure chamber 13*b*.

Ribs 28, for entraining a fluid, for example, water which emerges from the feed line 18 into the rotating ring chamber 24, are arranged in the ring chamber 24. Feed line 18 does not rotate during operation of the centrifuge.

The hydraulic fluid is discharged from the opening chamber 13*a* through a nozzle-like opening 25, which leads out of the opening chamber 13*a* outward from the drum 1.

Figure 2:
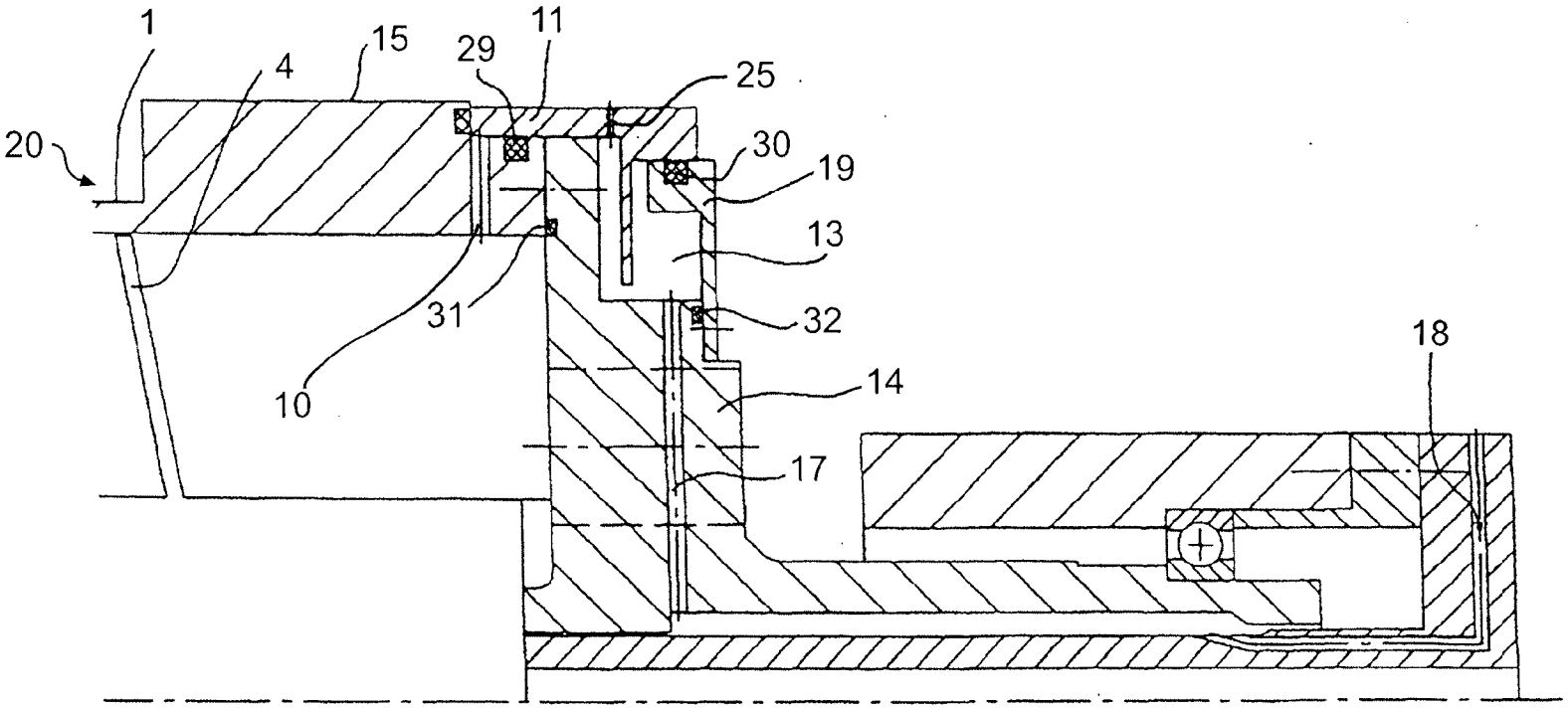
FIG. 2 shows a partial sectional view of a portion of a second embodiment of a solid-bowl screw centrifuge, according to the present disclosure.

In a first operating position, the ring 11 bears against the step 12 and closes the outlet openings 10 (see FIG. 2). In a second operating position, by contrast, ring 11 opens up the openings 10 (see FIG. 3), so that liquid is discharged out of the drum 1 through these outlet openings 10.

The functioning of hydraulic chamber 13 is discussed next.

If fluid, for example, water flows through the feed line 18 and enters the ring chamber 24, it is entrained in the circumferential direction by the ribs 28. In the hydraulic conduit 17, the fluid flows outward into the hydraulic chamber 13, where it collects in the closure chamber 13*b* on account of the rotation of the drum 1, so that the ring 11 is consequently pressed in a direction to the left as one views FIG. 1 into the closure position.

If additional water is passed into the hydraulic chamber 13, the additional water ultimately passes into the opening chamber 13*a*. Once the opening chamber 13*a* is full, the force on the attachment 16, acting in a direction to the right as one views, for example, FIG. 2, or towards the open position, is greater than the force acting on attachment 16 toward the closure position. Thus, the ring 11 moves to the right into the open position.

If the supply of water is stopped in the open position, the water flows out of the opening chamber 13*a* through the opening 25. By contrast, on account of the rotation of the drum 1, water remains in the closure chamber 13*b* and moves the ring 11 into the closure position.

In this way, accurate and fast, defined actuation is possible in a simple way and with a high operational reliability, which constitutes a major advantage over the prior art. A further advantage is that all the outlet openings 10 can be opened or closed using one master component, the ring 11.

A seal 27 in a groove in the step 12 reliably seals off a gap between a ring 11 and the drum 1 in the closure position.

Figure 3:
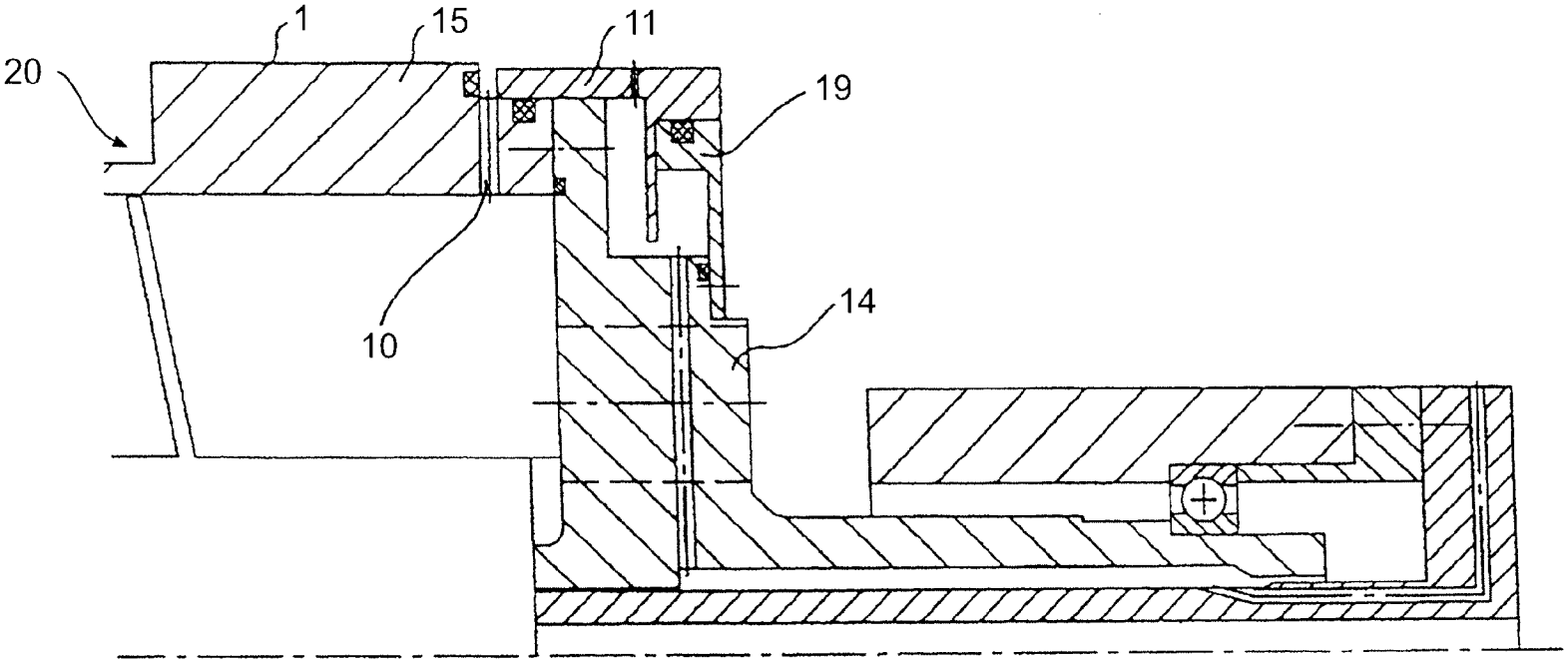
FIG. 3 shows the solid-bowl screw centrifuge of FIG. 2 in a second operating position.

In a region remote from the drum 1, the hydraulic chamber 13 is closed by a ring 19 which is secured to the drum lid 14 and also allows a fitting of the ring 11 (see FIG. 1). Ring 19 is also shown in the embodiment of FIGS. 2 and 3. The hydraulic chamber 13 is of compact and simple construction. Alternatively, it is within the scope of the present disclosure that hydraulic chamber 13 may be structured differently than shown in FIGS. 1-4 provided that the required function is fulfilled.

The ring 11 shown in FIGS. 1 to 3 rotates with the drum 1, since it must be able to completely close the outlet openings 10. Ring 11 also bears directly against the outside of the drum 1 and the drum lid 14.

Therefore, seals 29, 30 are arranged on the outer circumference of the drum 1 and of the ring 19 toward the inner circumference of the ring 11, so that it is substantially impossible for any fluid to escape through the gap between the ring 11 and the drum 1 or the drum lid 14 and the ring 19.

Furthermore, a sealing ring 31 is located between the drum lid 14 and the drum 1, and a sealing ring 32 is located between the ring 19 and the drum lid 14. A sealing ring 33 is also arranged around the hydraulic conduit 17 between the drum lid 14 and the part 23. Further seals 35, 36 are located on the inside of a scraper disk 22.

As shown, for example, in FIG. 1, the drum lid 14 is of internally conical design. A separation and/or clarification disk set made up of disks (not shown) could optionally also be located in this region, as is known from DE 10065 060.

In such a case, the outlet openings 10 are then formed in the lateral surface 20 of the drum 1 in such a manner that they lie radially outside the separation and/or clarification disk set, which is located downstream of the screw 4 and upstream of the liquid discharge 9.

In this way, the outlet openings 10 can also be used to discharge product and/or solids accumulating on the inner circumference of the drum lateral surface 20 in this axial region of the drum 1. The outlet openings 10 may also be located radially outside the screw 4 (not shown).

A further advantage of such a configuration is that the drum lid 14 is of internally conical design, so that at its outer circumferential contour there are advantageous possibilities for accommodating the hydraulics for displacement of the ring 11.

It is also within the scope of the present disclosure for the hydraulic chamber 13 to have opening chamber 13*a* and for one or more spring elements (not shown) to be provided for generating the closure force on the ring 11.

Figure 4:
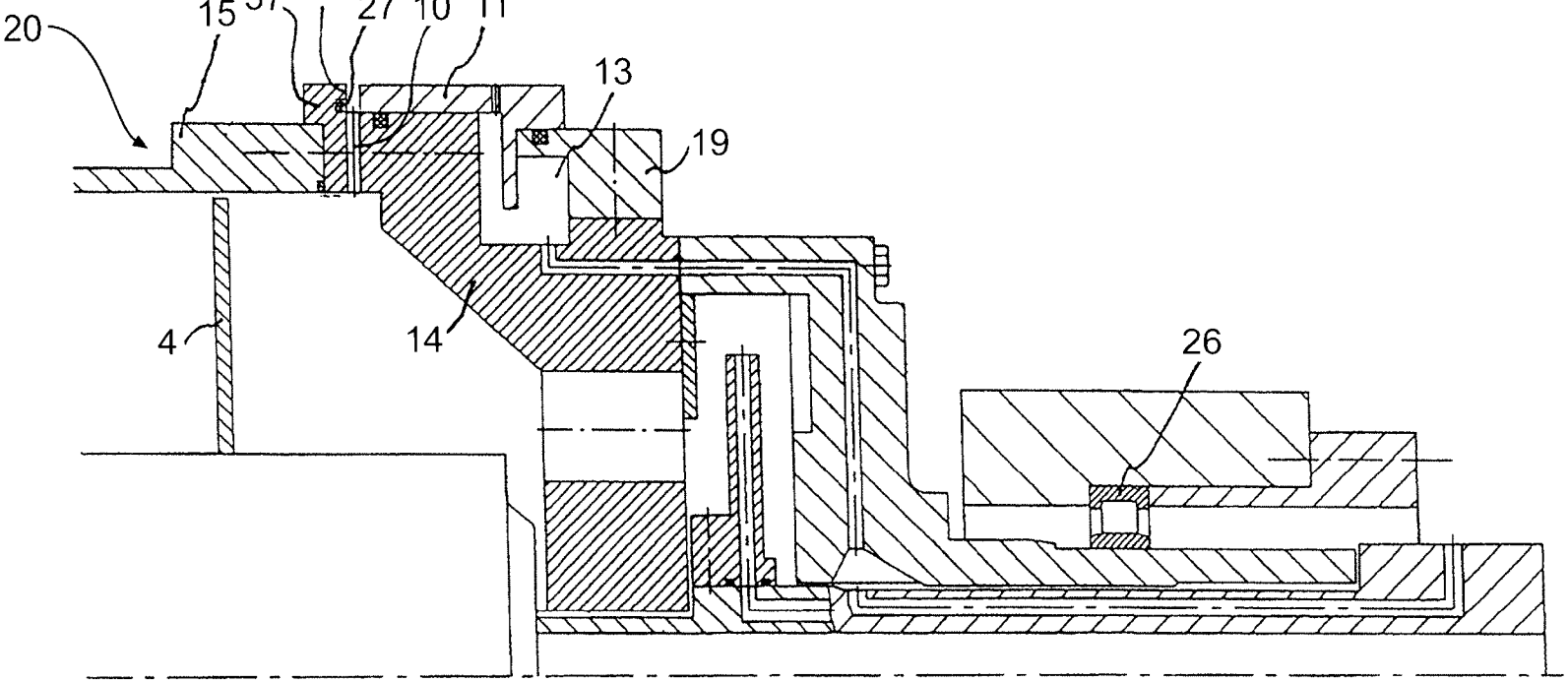
FIG. 4 shows a partial sectional view of a portion of a third embodiment of a solid-bowl screw centrifuge in a first operating position, according to the present disclosure.

FIG. 4 shows another embodiment, according to the present disclosure. The structure of this embodiment substantially corresponds to that of FIG. 1. However, unlike in FIG. 1, the outlet openings 10 are also formed in the drum lid 14.

The external contour of the drum 1 with the drum lid 14 as an overall unit scarcely changes as a result, since the only alteration is that the region of contact or the "interface" between the drum lid 14 and the drum 1 is shifted. That is, the drum 1 ends axially before the outlet openings 10.

The outlet openings 10 are formed axially in that end of the drum lid 14 which faces the drum 1. At its axial end before the drum 1, the drum lid 14 also has a radially protruding collar 37, which is provided with the step 12 and is here externally aligned with the collar 15 of the drum 1. Here, the ring 11 is in turn guided displaceably on the outer circumference of the drum lid 14.

The ring 11 bears against the step 12 in the closure position. This embodiment offers the functionality of the exemplary embodiment shown in FIG. 1. During production, there is no need for outlet openings 10 to be machined into the outer circumference of the drum 1.

Although the present disclosure has been described and illustrated in detail, it is to be clearly understood that this is done by way of illustration and example only and is not to be taken by way of limitation. The scope of the present disclosure is to be limited only by the terms of the appended claims.

The invention claimed is:

1. A solid-bowl centrifuge comprising:

a drum rotatable about a horizontal axis of rotation;

a screw arranged in the drum;

a continuous solids discharge located at a first end of the drum;

a continuous liquid discharge located at a second, opposite end of the drum;

at least one discontinuously acting outlet opening including a closure device located on a radially outermost lateral surface of the drum;

the closure device including a ring located on the radially outermost lateral surface of the drum and configured to be axially displaced along the radially outermost surface of the drum relative to the horizontal axis of rotation and rotatable with the drum during an operation of the centrifuge; and an actuating device assigned to the closure device by which actuating device the ring is displaced into a first position which opens the at least one outlet opening and into a second position which closes the at least one outlet opening.

2. The solid-bowl screw centrifuge according to claim 1, wherein the actuating device is a fluidic actuating device.

3. The solid-bowl screw centrifuge according to claim 1, wherein the actuating device is a hydraulic actuating device.

4. The solid-bowl screw centrifuge according to claim 1, wherein the at least one outlet opening is arranged axially before the continuous liquid discharge.

5. The solid-bowl screw centrifuge according to claim 1, wherein the at least one outlet opening lies radially outside the screw.

6. The solid-bowl screw centrifuge according to claim 1, wherein the at least one outlet opening is formed in an end region of a drum lateral surface which faces a drum lid.

7. The solid-bowl screw centrifuge according to claim 6, wherein the drum lateral surface, at its axial end before the drum lid, includes a radially protruding collar having a step, and the at least one outlet opening is formed in a region including the step.

8. The solid-bowl screw centrifuge according to claim 6, wherein a hydraulic chamber is formed one of on and in the drum lid.

9. The Solid-bowl screw centrifuge according to claim 8, wherein the drum lid has an internally conical design, and the hydraulic chamber is formed at an outer circumference of the drum lid.

10. The solid-bowl screw centrifuge according to claim 8, wherein the hydraulic chamber includes an opening chamber and a closure chamber which are operatively connected.

11. The solid-bowl screw centrifuge according to claim 10, wherein the opening chamber includes an opening, which opening leads outward from the hydraulic chamber out of the drum to discharge hydraulic fluid from the hydraulic chamber.

12. The solid-bowl screw centrifuge according to claim 8, wherein the ring includes a radial attachment extending into the hydraulic chamber, and a hydraulic conduit opens into the hydraulic chamber.

13. The solid-bowl screw centrifuge according to claim 12, wherein the hydraulic conduit passes through the drum lid and an adjoining part and is operatively connected to another hydraulic conduit on a non-rotating feed pipe.

14. The solid-bowl screw centrifuge according to claim 8, wherein the hydraulic chamber, in a region located remote from the drum, is closed by a ring secured to the drum lid.

15. The solid-bowl centrifuge according to claim 1, wherein the at least one discontinuously acting outlet opening is formed as an aperture in the form of a slot or a hole.

16. A solid-bowl centrifuge comprising:

a drum rotatable about a horizontal axis of rotation the drum having a drum lid at an end thereof;

a screw arranged in the drum;

a continuous solids discharge located at a first end of the drum;

a continuous liquid discharge located at a second, opposite end of the drum;

at least one discontinuously acting outlet opening including a closure device located on a radially outermost lateral surface of the drum lid;

the closure device including a ring located on the radially outermost lateral surface of the drum lid and configured to be axially displaced along the radially outermost surface of the drum lid relative to the horizontal axis of rotation and rotatable with the drum during an operation of the centrifuge;

an actuating device assigned to the closure device by which actuating device the ring is displaced into a first position which opens the at least one outlet opening and into a second position which closes the at least one outlet opening; and wherein the at least one outlet opening is formed in the drum lid.

17. The solid-bowl screw centrifuge according to claim 16, wherein the drum lid includes a radially projecting collar having a step.

* * * * *